US005581263A

United States Patent [19]

Maeda et al.

[11] Patent Number: 5,581,263

[45] Date of Patent: Dec. 3, 1996

[54] WINDOW GLASS ANTENNA WITH OPTIMIZED AM AND FM EQUIVALENT ANTENNAS

[75] Inventors: Masaru Maeda, Kyoto; Koji Komoda, Hiroshima, both of Japan

[73] Assignee: Nippon Sheet Glass Co., Ltd., Japan

[21] Appl. No.: 293,650

[22] Filed: Aug. 22, 1994

[30] Foreign Application Priority Data

Aug. 20, 1993 [JP] Japan ..... 5-206485

[51] Int. Cl.[6] ..... H01Q 1/32

[52] U.S. Cl. ..... 343/704; 343/713

[58] Field of Search ..... 343/704, 713; H01Q 1/32

[56] References Cited

U.S. PATENT DOCUMENTS

| | | | |
|---|---|---|---|
| 3,728,732 | 4/1973 | Igarashi | 343/713 |
| 4,063,247 | 12/1977 | Sakurai et al. | 343/704 |
| 4,086,594 | 4/1978 | Kropielnicki et al. | 343/704 |
| 4,914,447 | 4/1990 | Ishii et al. | 343/713 |
| 5,185,612 | 2/1993 | Tsukada et al. | 343/713 |
| 5,229,780 | 7/1993 | Hiroshi et al. | 343/713 |
| 5,239,303 | 8/1993 | Hirotsu et al. | 343/713 |

FOREIGN PATENT DOCUMENTS

| | | | |
|---|---|---|---|
| 0559196 | 9/1993 | European Pat. Off. . | |
| 2746419 | 11/1978 | Germany | 343/704 |
| 57-148405 | 9/1982 | Japan | 343/704 |
| 57-188102 | 11/1982 | Japan . | |
| 2131622 | 6/1984 | United Kingdom . | |

*Primary Examiner*—Hoanganh Le

*Attorney, Agent, or Firm*—Merchant, Gould, Smith, Edell, Welter & Schmidt

[57] ABSTRACT

A window glass antenna for receiving AM and FM broadcast radiowaves in a diversity reception mode includes an inverted T-shaped antenna wire, a plurality of horizontal defrosting hot wires spaced from the inverted T-shaped antenna wire, an inductive coupling wire connecting the inverted T-shaped antenna wire and the horizontal defrosting hot wires to each other, power supply lines connected to the horizontal defrosting hot wires for energizing the horizontal defrosting hot wires, and first and second high-frequency blocking coils inserted in the power supply lines, the second high-frequency blocking coils being connected between the first high-frequency blocking coils and the horizontal defrosting hot wires. An AM broadcast signal can be received by the horizontal defrosting hot wires and portions of the power supply lines which are bounded by the first high-frequency blocking coils. A first FM broadcast signal can be received by the inverted T-shaped antenna wire, and a second FM broadcast signal can be received by the horizontal defrosting hot wires and portions of the power supply lines which are bounded by the second high-frequency blocking coils.

4 Claims, 10 Drawing Sheets

| FREQUENCY / ANTENNA | 666 (KHz) | 828 | 1035 | 1161 | 1458 | 1584 |
|---|---|---|---|---|---|---|
| POLE ANTENNA | 0 (dBμV) | 0 | 0 | 0 | 0 | 0 |
| WINDOW GLASS ANTENNA 1 | 3.3 (dBμV) | 3.0 | 2.5 | 2.0 | 2.2 | 2.0 |

FIG. 5

UNIT:dB

| (MHz) FREQUENCY | MAIN | | | AUXILIARY | | |
|---|---|---|---|---|---|---|
| | WITH IMP | WITHOUT IMP | DIFFERENCE | WITH IMP | WITHOUT IMP | DIFFERENCE |
| 88 | −6 | −5.9 | −0.1 | −9.1 | −9.1 | 0 |
| 89 | −8.3 | −8.2 | −0.1 | −10.7 | −10.6 | −0.1 |
| 90 | −7.6 | −7.5 | −0.1 | −10.4 | −10.5 | 0.1 |
| 91 | −6.7 | −6.6 | −0.1 | −10.2 | −10.3 | 0.1 |
| 92 | −6 | −5.9 | −0.1 | −10.8 | −10.8 | 0 |
| 93 | −7.3 | −7 | −0.3 | −11.5 | −11.3 | −0.2 |
| 94 | −8.2 | −7.7 | −0.5 | −11.2 | −11.1 | −0.1 |
| 95 | −6.6 | −6.1 | −0.5 | −10.5 | −10.5 | 0 |
| 96 | −5.8 | −5.2 | −0.6 | −10.5 | −10.7 | 0.2 |
| 97 | −5.3 | −4.5 | −0.8 | −10.4 | −10.7 | 0.3 |
| 98 | −6.5 | −5 | −1.5 | −11.8 | −12 | 0.2 |
| 99 | −7.1 | −5.8 | −1.3 | −12.9 | −12.9 | 0 |
| 100 | −6.9 | −5.5 | −1.4 | −13.6 | −13.2 | −0.4 |
| 101 | −5.3 | −4.8 | −0.5 | −13.8 | −13 | −0.8 |
| 102 | −4.5 | −4.5 | 0 | −13.1 | −12.2 | −0.9 |
| 103 | −3.7 | −3.9 | 0.2 | −11.4 | −10.5 | −0.9 |
| 104 | −5 | −5.3 | 0.3 | −11.6 | −10.8 | −0.8 |
| 105 | −4.4 | −4.9 | 0.5 | −10.5 | −9.7 | −0.8 |
| 106 | −3.3 | −4 | 0.7 | −9.2 | −8.4 | −0.8 |
| 107 | − 5.4 | −6.1 | 0.7 | −9.9 | −9.3 | −0.6 |
| 108 | −5.9 | −7 | 1.1 | −9.6 | −8.8 | −0.8 |
| AVERAGE | −− | −− | −0.2 | −− | −− | −0.3 |

REFERENCE WITH NO COUPLING WIRE

FIG. 7

UNIT:dB

| (MHz) FREQUENCY | REAR POLE | MAIN | | AUXILIARY | | DIVERSITY | |
|---|---|---|---|---|---|---|---|
| | MEASURED GAIN | MEASURED GAIN | DIFFERENCE | MEASURED GAIN | DIFFERENCE | MEASURED GAIN | DIFFERENCE |
| 88 | −5.5 | −4.9 | 0.6 | −9 | −3.5 | −4.2 | 1.3 |
| 89 | −6 | −5.7 | 0.3 | −8.9 | −2.9 | −4.9 | 1.1 |
| 90 | −5 | −5.9 | −0.9 | −8 | −3 | −5.2 | −0.2 |
| 91 | −4.7 | −5.5 | −0.8 | −8.2 | −3.5 | −5.2 | −0.5 |
| 92 | −3.7 | −4 | −0.3 | −10.1 | −6.4 | −4 | −0.3 |
| 93 | −3.4 | −4.7 | −1.3 | −10.7 | −7.3 | −4.7 | −1.3 |
| 94 | −2.9 | −6.5 | −3.6 | −10.5 | −7.6 | −6.4 | −3.5 |
| 95 | −3.1 | −6.6 | −3.5 | −10 | −6.9 | −6.6 | −3.5 |
| 96 | −2.6 | −5 | −2.4 | −9.5 | −6.9 | −5 | −2.4 |
| 97 | −2.7 | −4.3 | −1.6 | −8.8 | −6.1 | −4.3 | −1.6 |
| 98 | −2.8 | −4.9 | −2.1 | −8.9 | −6.1 | −4.9 | −2.1 |
| 99 | −3.2 | −6.2 | −3 | −9.3 | −6.1 | −6.2 | −3 |
| 100 | −3.7 | −5.3 | −1.6 | −8.7 | −5 | −5.3 | −1.6 |
| 101 | −4.2 | −4.2 | 0 | −8.6 | −4.4 | −4.2 | 0 |
| 102 | −4.4 | −3.1 | 1.3 | −9.4 | −5 | −3.1 | 1.3 |
| 103 | −4.8 | −2.7 | 2.1 | −10.3 | −5.5 | −2.7 | 2.1 |
| 104 | −5.3 | −3.4 | 1.9 | −10.7 | −5.4 | −3.4 | 1.9 |
| 105 | −7.2 | −4.1 | 3.1 | −10.9 | −3.7 | −4.1 | 3.1 |
| 106 | −6.6 | −3.4 | 3.2 | −9.5 | −2.9 | −3.4 | 3.2 |
| 107 | −6.4 | −3.7 | 2.7 | −8.5 | −2.1 | −3.7 | 2.7 |
| 108 | −7.2 | −4.8 | 2.4 | −8.3 | −1.1 | −4.8 | 2.4 |
| | −4.5 | −4.8 | −0.2 | −9.3 | −4.8 | −4.7 | −0.0 |

DIFFERENCE: DIFFERENCE BETWEEN GAINS OF REAR POLE AND WINDOW GLASS ANTENNA FOR MAIN, AUXILIARY, AND DIVERSITY RECEPTION

WINDOW GLASS ANTENNA WITH OPTIMIZED AM AND FM EQUIVALENT ANTENNAS

BACKGROUND OF THE INVENTION

1. Field of the Invention

The present invention relates to a window glass antenna for use on a window glass panel such as an automobile window glass panel.

2. Description of the Prior Art

One conventional window glass antenna known from Japanese laid-open patent publication No. 57-188102 is shown in FIG. 13 of the accompanying drawings.

The window glass antenna shown in FIG. 13 is used to receive both AM (amplitude-modulated) and FM (frequency-modulated) broadcast radiowaves, and capable of diversity reception of FM radiowaves.

The window glass antenna, generally designated by the reference numeral 100 in FIG. 13, comprises a plurality of defrosting hot wires 102 disposed on a window glass panel 101 and extending horizontally thereon, an inverted T-shaped antenna wire 103 disposed on the window glass panel 101 in an unheated region above the defrosting hot wires 102, a capacitive coupling wire 104 disposed on the window glass panel 101 between the defrosting hot wires 102 and the inverted T-shaped antenna wire 103 and providing a capacitive coupling therebetween, the capacitive coupling wire 104 having a low impedance at relatively low frequencies such as AM broadcast frequencies, power supply lines 111 connected between the defrosting hot wires 102 and a hot-wire power supply 110, and high-frequency blocking coils 112 inserted in the power supply lines 111 for providing a high impedance with respect to signals having relatively low frequencies such as AM broadcast frequencies. The defrosting hot wires 102 have a horizontal length of L11. The-power supply lines 111 have a length L10 extending from the high-frequency blocking coils 112 to the defrosting hot wires 102.

The inverted T-shaped antenna wire 103 includes a vertical wire section 103*a* having an upper end 103*b* connected to an auxiliary antenna wire 105 which is in turn connected through a first feeding point 106 to a first high-frequency amplifier 113. AM/FM (main) broadcast radio wave signals are received from the inverted T-shaped antenna wire 103 through the auxiliary antenna wire 105, the first feeding point 106, and the first high-frequency amplifier 113. The defrosting hot wires 102 have right-hand ends (as viewed in FIG. 13) connected to a bus 107 which includes a second feeding point 108 connected to a second high-frequency amplifier 114. FM (auxiliary) broadcast radio wave signals are received from the defrosting hot wires 102 through the bus 107, the second feeding point 108, and the second high-frequency amplifier 114.

AM broadcast radio wave signals of the AM/FM (main) broadcast radio wave signals which have been amplified by the first high-frequency amplifier 113 are supplied to an AM antenna terminal of an AM/FM receiver (not shown). FM (main) broadcast radio wave signals of the amplified AM/FM (main) broadcast radio wave signals are supplied to one input terminal of a selector switch (not shown).

The FM (auxiliary) broadcast radio wave signals which have been amplified by the second high-frequency amplifier 114 are supplied to the other input terminal of the selector switch.

The selector switch selects one of the supplied FM (main and auxiliary) broadcast radio wave signals, which is of a higher signal level than the other, and the selected signal is supplied to an FM antenna terminal of the AM/FM receiver. Since the FM signal having a higher signal level is always selected by the selector switch in the FM signal reception mode, the FM signal can be received more stably than it is with a single antenna.

The AM broadcast radio wave signals are received by an AM-reception equivalent antenna having an effective length which is equal to the sum of the length L10 of the power supply lines 111 and the length L11 of the defrosting hot wires 102. The received AM broadcast radio wave signals are supplied through the capacitive coupling wire 104 to the inverted T-shaped antenna wire 103.

Because the received AM broadcast radio wave signals are transmitted through the capacitive coupling wire 104, however, the impedance with respect to the AM broadcast radio wave signals is higher than with respect to the FM broadcast radio wave signals, and hence no sufficient gain has been available for the reception of AM broadcast radio wave signals.

The FM (auxiliary) broadcast radio wave signals are received by the AM-reception equivalent antenna described above. The length L10 of the power supply lines 111 is not optimum for the reception of FM broadcast radio wave signals since the length L10 is determined primarily in view of other design considerations. Furthermore, inasmuch as an end of one of the power supply lines 111 is grounded through one of the high-frequency blocking coils 112, the antenna impedance is relatively low for the reception of FM (auxiliary) broadcast radio wave signals, and the gain therefor has not been high enough.

The high-frequency amplifiers 113, 114 are connected to compensate for the reductions in the gains for the reception of AM and FM broadcast radio wave signals. While the high-frequency amplifiers 113, 114 are effective in compensating for the gain reductions, they are responsible for increased white noise, an increase in the cost of manufacture, and a reduction in the sensitivity due to signal saturation in geographic regions where the field strength is high.

SUMMARY OF THE INVENTION

It is an object of the present invention to provide a window glass antenna which is capable of receiving AM and FM radiowaves with high sensitivity even without high-frequency amplifiers.

According to the present invention, there is provided a window glass antenna on a window glass panel, comprising defrosting hot wires disposed on the window glass panel and extending substantially horizontally, an inverted T-shaped antenna wire disposed on the window glass panel in an unheated region above the defrosting hot wires, an inductive coupling wire interconnecting the defrosting hot wires and the inverted T-shaped antenna wire for providing a relatively low impedance with respect to a relatively low frequency band, a hot-wire power supply, power supply lines connected between the defrosting hot wires and the hot-wire power supply, and a first high-frequency blocking coil inserted in the power supply lines for providing a high impedance with respect to the relatively low frequency band, the arrangement being such that a first antenna output signal can be picked up from an end of the inverted T-shaped antenna wire and a second antenna output signal can be picked up from an end of the defrosting hot wires.

According to the present invention, there is also provided a window glass antenna for receiving AM and FM broadcast radiowaves in a diversity reception mode, comprising a window glass panel, an inverted T-shaped antenna wire disposed on the window glass panel, a plurality of horizontal defrosting hot wires disposed on the window glass panel in spaced relationship to the inverted T-shaped antenna wire, an inductive coupling wire disposed on the window glass panel and connecting the inverted T-shaped antenna wire and the horizontal defrosting hot wires to each other, power supply lines connected to the horizontal defrosting hot wires for energizing the horizontal defrosting hot wires, and first and second high-frequency blocking coils inserted in the power supply lines, the second high-frequency blocking coils being connected between the first high-frequency blocking coils and the horizontal defrosting hot wires, the arrangement being such that an AM broadcast signal can be received by the horizontal defrosting hot wires and portions of the power supply lines which are bounded by the first high-frequency blocking coils, a first FM broadcast signal can be received by the inverted T-shaped antenna wire, and a second FM broadcast signal can be received by the horizontal defrosting hot wires and portions of the power supply lines which are bounded by the second high-frequency blocking coils.

The inverted T-shaped antenna wire may include a horizontal antenna section, the inductive coupling wire being of a zigzag pattern connected between the horizontal antenna section and an end of the horizontal defrosting hot wires.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 5 is a table of measured frequency-dependent gains of the window glass antenna shown in FIG. 1 in an FM broadcast band;

FIG. 7 is a table of measured frequency-dependent gains of the window glass antenna shown in FIG. 1 in the FM broadcast band;

DETAILED DESCRIPTION OF THE PREFERRED EMBODIMENTS

Figure 1:
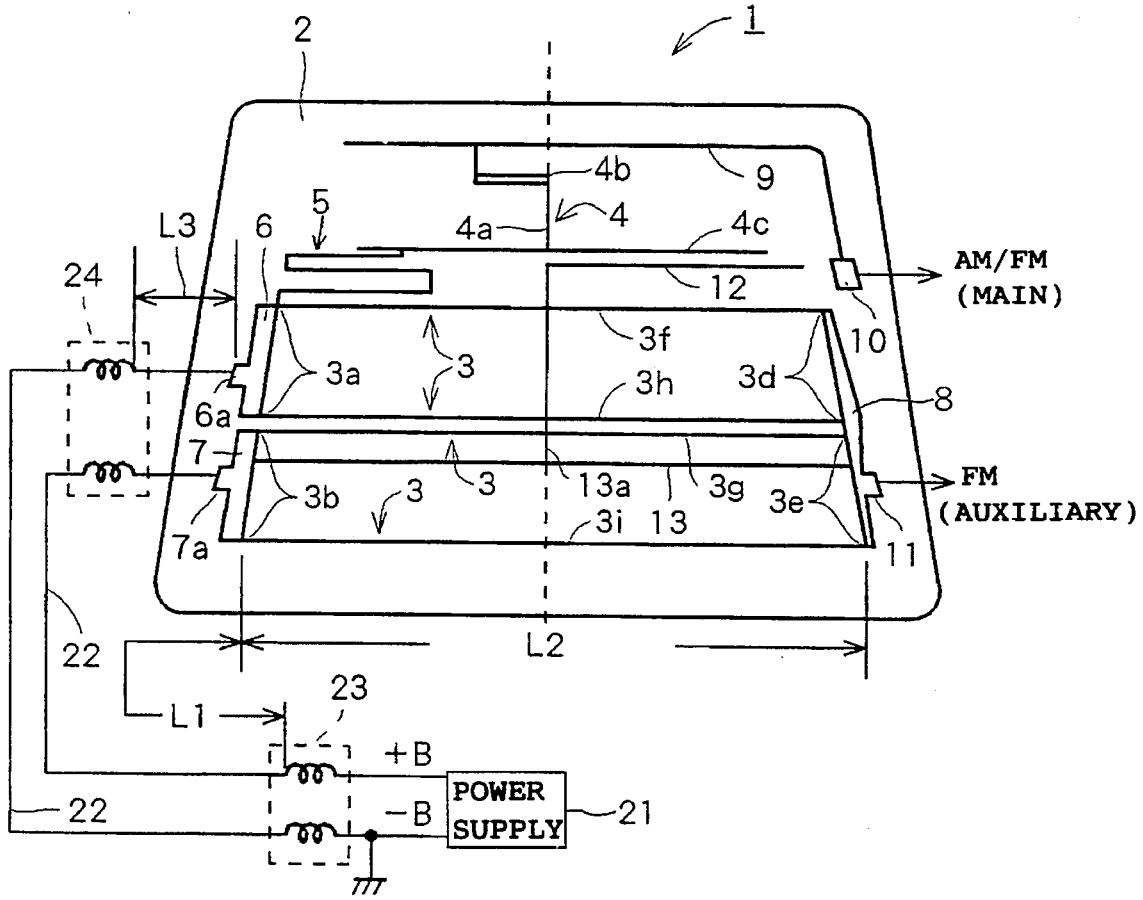
FIG. 1 is a schematic view of a window glass antenna according to a first embodiment of the present invention.

As shown in FIG. 1, a window glass antenna according to a first embodiment of the present invention comprises a plurality of defrosting hot wires 3 disposed on a rear window glass panel 2 of an automobile (not shown) and extending horizontally thereon, an inverted T-shaped antenna wire 4 disposed on the window glass panel 2 in an unheated region above the defrosting hot wires 3, an inductive coupling wire 5 disposed on the window glass panel 2 and connected between the defrosting hot wires 3 and the inverted T-shaped antenna wire 4, the inductive coupling wire 5 having a low impedance at relatively low frequencies such as AM broadcast frequencies, buses 6, 7 connected to left-hand ends (as viewed in FIG. 1) 3*a*, 3*b* of respective upper and lower groups of the defrosting hot wires 3, the buses 6, 7 having respective power supply input terminals 6*a*, 7*a*, power supply lines 22 connected between the power supply input terminals 6*a*, 7*a* and a hot-wire power supply 21, and first and second high-frequency blocking coils 23, 24 inserted in the power supply lines 22. The defrosting hot wires 3 in the upper and lower groups have respective right-hand ends 3*d*, 3*e* connected to a common bus 8 which is shared by the upper and lower groups of the defrosting hot wires 3.

The inverted T-shaped antenna wire 4 includes a vertical antenna section 4*a* having an upper end 4*b* and a horizontal antenna section 4*c* joined to the lower end of the vertical antenna section 4*a*. The vertical antenna section 4*a* is connected to a first auxiliary wire 9 disposed on the window glass panel 2 and having a first feeding point 10 on an end thereof which is connected to an AM/FM receiver (not shown). The common bus 8 has a second feeding point 11 which is also connected to the AM/FM receiver.

The upper group of the defrosting hot wires 3 is composed of nine defrosting hot wires 3, and the lower group of the defrosting hot wires 3 is also composed of nine defrosting hot wires 3. Of these defrosting hot wires 3, only uppermost defrosting hot wires 3*f*, 3*g* and lowermost defrosting hot wires 3*h*, 3*i* in the upper and lower groups are shown for illustrative purpose, and other defrosting hot wires are omitted from illustration. Each of the upper and lower groups of the defrosting hot wires 3 may be composed of more or less defrosting hot wires 3.

The inductive coupling wire 5 has a lower end connected to the left-hand end 3*a* of the uppermost defrosting hot wire 3*f*, and extends upwardly in a zigzag pattern with an upper end connected to the horizontal antenna section 4*c* of the inverted T-shaped antenna wire 4. The zigzag pattern of the inductive coupling wire 5 provides an inductance whose value is determined to provide a sufficient low impedance with respect to AM broadcast radiowaves having frequencies lower than FM broadcast radiowaves.

The first high-frequency blocking coils 23 are connected to respective terminals of the hot-wire power supply 21, and the second high-frequency blocking coils 24 are connected to the power supply input terminals 6*a*, 7*a*, respectively.

The first high-frequency blocking coils 23, which are of conventional nature, provide a high impedance with respect to relatively low frequencies such as AM broadcast radio wave frequencies. The first high-frequency blocking coils 23 may comprise toroidal coils or other coils insofar as they can block AM broadcast radio wave signals.

The second high-frequency blocking coils 24, which are employed according to the present invention, provide a high impedance with respect to FM broadcast radio wave frequencies which are higher than AM broadcast radio wave frequencies. The second high-frequency blocking coils 24 may comprise bifilar toroidal coils for low loss and small size, or other coils insofar as they can block FM broadcast radio wave signals. It is preferable that the second high-frequency blocking coils 24 have an impedance of about 3.6 μH or higher, and have a core with a small loss in an FM frequency band.

The power supply lines 22 have portions extending between the first high-frequency blocking coils 23 and the power supply input terminals *6a, 7a* and having a length L1, and the defrosting hot wires 3 have a horizontal length L2. An AM-reception equivalent antenna is composed of those portion of the power supply lines 22 and the defrosting hot wires 3, i.e., has an effective length which is equal to the sum of the length L1 and the length L2.

The power supply lines 22 have portions extending between the second high-frequency blocking coils 24 and the power supply input terminals *6a, 7a* and having a length L3. An FM-reception equivalent antenna is composed of those portion of the power supply lines 22 and the defrosting hot wires 3, i.e., has an effective length which is equal to the sum of the length L3 and the length L2.

Since it is difficult to theoretically determine the equivalent antenna length of the defrosting hot wires 3, the equivalent antenna length is actually determined by adjusting the positions of the coils 23, 24, i.e., the lengths L1, L3. The length L1 may be of a conventional value, but an appropriate value of the length L3 has experimentally been found to be of about 30 cm though it depends on the type of the automobile on which the window glass antenna is mounted.

AM/FM (main) broadcast radio wave signals are received from the inverted T-shaped antenna wire 4 through the first auxiliary wire 9 and the first feeding point 10. FM (auxiliary) broadcast radio wave signals are received from the defrosting hot wires 3 through the bus 8 and the second feeding point 11.

The AM broadcast radio wave signals are supplied to an AM antenna terminal of the AM/FM receiver through a signal cable (not shown), and the FM (main and auxiliary) broadcast radio wave signals are supplied to an FM input terminal of the AM/FM receiver through a signal cable (not shown) and a selector switch (not shown).

The window glass antenna 1 according to the present invention additionally includes second and third auxiliary wires 12, 13 disposed on the window glass panel 2. The second auxiliary wire 12 extends upwardly from the center of the defrosting hot wire *3h*, is bent to the right immediately below the horizontal antenna section *4c* of the inverted T-shaped antenna wire 4, and then extends horizontally parallel to the horizontal antenna section *4c*. The third auxiliary wire 13 extends as a vertical section *13a* downwardly from the center of the defrosting hot wire *3g*, is bent to the right and left below the defrosting hot wire *3g*, and extends horizontally parallel to the defrosting hot wire *3g* until it is connected to the buses 7, 8. The second and third auxiliary wires 12, 13 are included for impedance adjustment, and are not limited to the illustrated patterns.

Operation of the window glass antenna 1 will be described below.

FM (main) broadcast radiowaves are received by the inverted T-shaped antenna wire 4, and signals representing the received FM (main) broadcast radiowaves are picked up from the first feeding point 10.

AM broadcast radiowaves are received by the AM-reception equivalent antenna having the effective antenna length equal to the sum of the lengths L1, L2, and signals representing the received AM broadcast radiowaves are supplied through the inductive coupling wire 5, the inverted T-shaped antenna wire 4, and the first auxiliary wire 9 and picked up from the first feeding point 10.

Since the AM broadcast radio wave signals are transmitted through the inductive coupling wire 5, rather than the conventional capacitive coupling wire, the impedance of the window glass antenna 1 is sufficiently low with respect to relatively low frequencies such as AM broadcast radio wave frequencies. Therefore, it is possible to transmit the AM broadcast radio wave signals to the inverted T-shaped antenna wire 4 with a low loss.

An optimum antenna length for the reception of AM broadcast radiowaves can be obtained by adjusting the position of the first high-frequency blocking coil 23, i.e., adjusting the length L1 of the power supply lines 22, as with the conventional window glass antenna.

FM (auxiliary) broadcast radiowaves are received by the FM-reception equivalent antenna having the effective antenna length equal to the sum of the lengths L3, L2, and signals representing the received FM broadcast radiowaves are supplied to the bus 8 and picked up from the second feeding point 11.

According to the present invention, not a single high-frequency blocking coil is used for the reception of both AM and FM broadcast radiowaves, but the first and second high-frequency blocking coils 23, 24 are used for the reception of AM and FM broadcast radiowaves, respectively. Therefore, there are provided equivalent antenna lengths optimum for receiving respective AM and FM broadcast radiowaves with a low loss.

The inductive coupling wire 5 presents a high impedance with respect to FM broadcast radiowaves. Consequently, the inverted T-shaped antenna wire 4 and the defrosting hot wires 3 are virtually severed from each other in a high frequency range for the reception of FM broadcast radiowaves. The inverted T-shaped antenna wire 4 and the defrosting hot wires 3 thus can perform their diversity antenna functions sufficiently without being adversely affected from each other.

The window glass antenna 1 can thus receive AM/FM (main) broadcast radiowaves and FM (auxiliary) broadcast radiowaves with practically sufficient sensitivity even without any high-frequency amplifiers between the feeding points 10, 11 and the AM/FM receiver. Because no high-frequency amplifiers are required, any white noise is reduced, the cost of manufacture is lowered, and the antenna sensitivity is prevented from being reduced due to signal saturation in geographic regions where the field strength is high.

Figure 2:
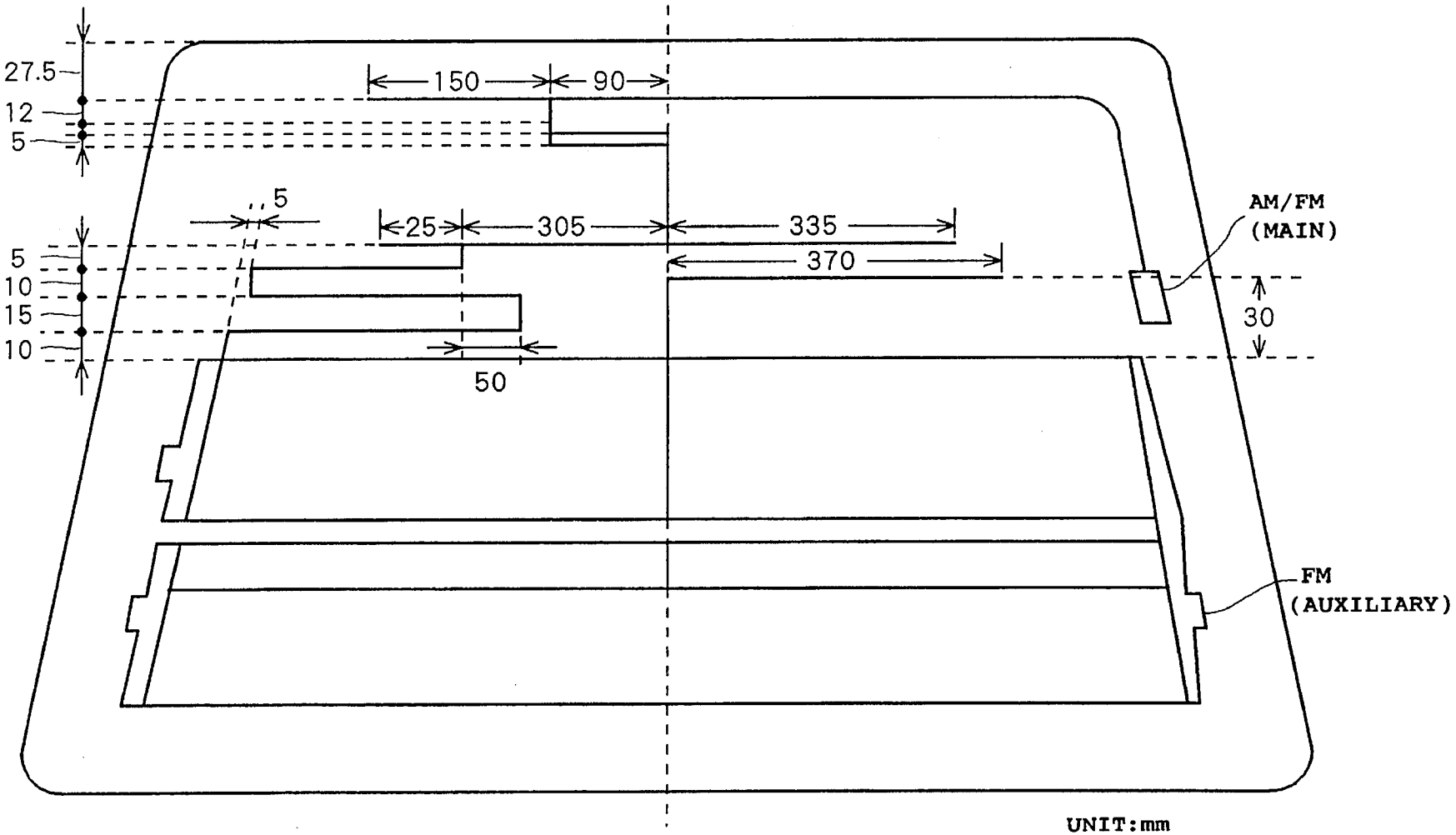
FIG. 2 is an enlarged diagram showing dimensions of the window glass antenna shown in FIG. 1.

FIG. 2 shows various dimensions of the window glass antenna 1 shown in FIG. 1. The illustrated specific dimensions are selected for the reception of an FM broadcast band in countries other than Japan. It is possible to vary the dimensions to make the window glass antenna 1 suitable for the reception of an FM broadcast band in Japan.

Experimentally obtained data of the window glass antenna 1 are shown in FIGS. 3 through 8.

Figures 3, 4:
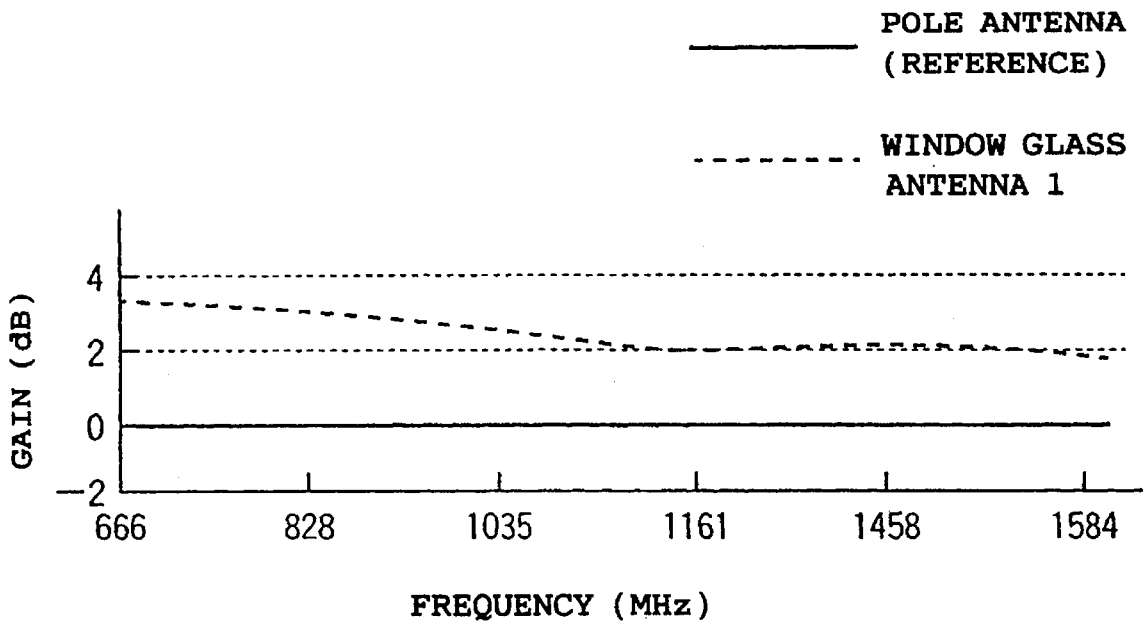
FIG. 3 is a table of measured frequency-dependent gains of the window glass antenna shown in FIG. 1 in an AM broadcast band.
FIG. 4 is a graph showing the frequency-dependent gains of the window glass antenna shown in FIG. 1 in the AM broadcast band.

FIG. 3 shows measured frequency-dependent gains of the window glass antenna 1 shown in FIG. 1 in an AM broadcast band. The gains at respective selected frequencies of the window glass antenna 1 (with the inductive coupling wire 5) shown in FIG. 1 were measured in comparison with the gains of 0 dBμV at the respective frequencies of an average pole antenna having a length of 920 mm. The measured frequency-dependent gains are also plotted in a graph shown in FIG. 4.

As shown in FIG. 4, the gain of the window glass antenna 1 shown in FIG. 1 is higher than the gain of the average pole antenna in the entire AM broadcast frequency range. It has experimentally been known that the gain of an antenna with a capacitive coupling wire is equal to or lower than the gain of the average pole antenna.

FIG. 5 shows measured frequency-dependent gains of the window glass antenna 1 shown in FIG. 1 in an FM broadcast band. The gains of the window glass antenna 1 with and without the inductive coupling wire 5 (referred to as "IMP") at various FM broadcast radio wave frequencies, and the differences between those gains are shown in FIG. 5. The differences between the gains are also plotted in a graph shown in FIG. 6.

Figure 6:
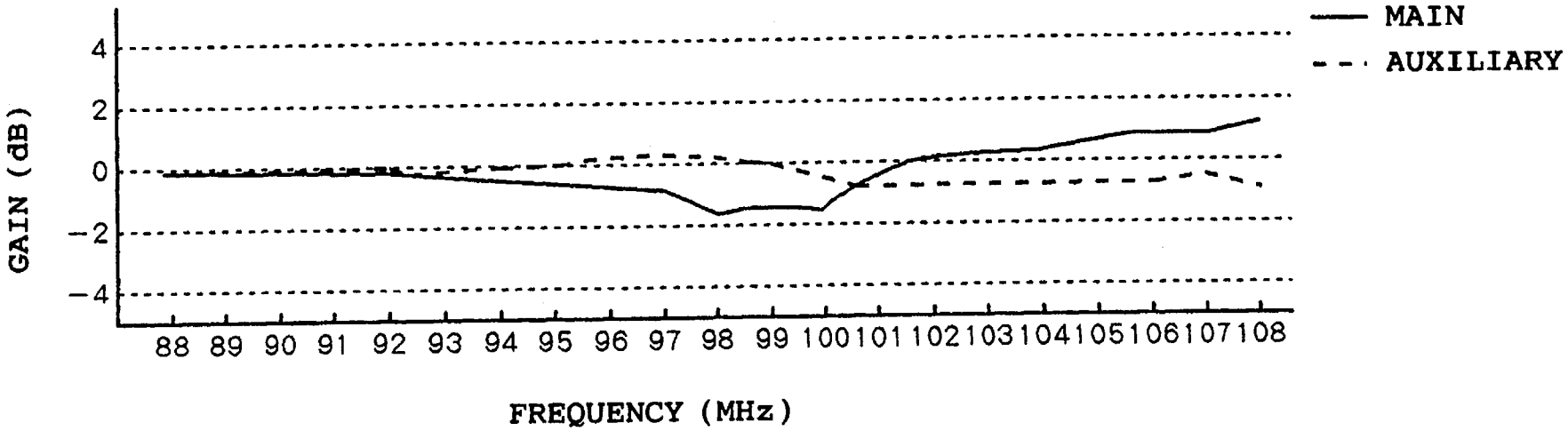
FIG. 6 is a graph showing the frequency-dependent gains of the window glass antenna shown in FIG. 1 in the FM broadcast band.

A study of FIG. 6 indicates that any gain reduction caused with the inductive coupling wire 5 connected is small with respect to FM (main) broadcast waves and FM (auxiliary) broadcast waves, and hence the window glass antenna 1 has practically sufficient sensitivity with the inductive coupling wire 5 connected.

FIG. 7 shows measured frequency-dependent gains of the window glass antenna 1 shown in FIG. 1 in the FM broadcast band. The gains of the window glass antenna 1 for FM (main), FM (auxiliary), and FM diversity reception, the gains of a rear pole antenna, and the difference between the gains of the window glass antenna 1 and the gains of the rear pole antenna at various FM broadcast radio wave frequencies are shown in FIG. 7. The differences between the gains are also plotted in a graph shown in FIG. 8.

Figure 8:
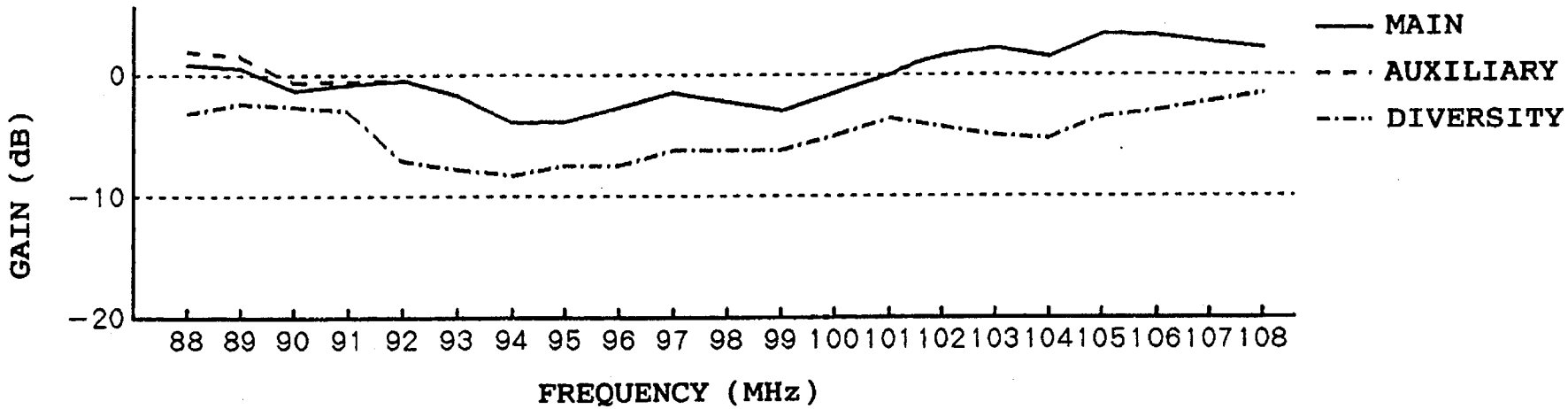
FIG. 8 is a graph showing the frequency-dependent gains of the window glass antenna shown in FIG. 1 in the FM broadcast band.

It can be seen from FIG. 8 that the gains of the window glass antenna 1 for FM (main), FM (auxiliary), and FM diversity reception with the inductive coupling wire 5 connected are close to the gains of the rear pole antenna.

FIGS. 9 through 12 show window glass antennas according to second through fifth embodiments, respectively, of the present invention. In each of FIGS. 9 through 12, high-frequency blocking coils 23, 24, power supply lines 22, and a hot-wire power supply 21, which are identical to those shown in FIG. 1, are omitted from illustration.

Figure 9:
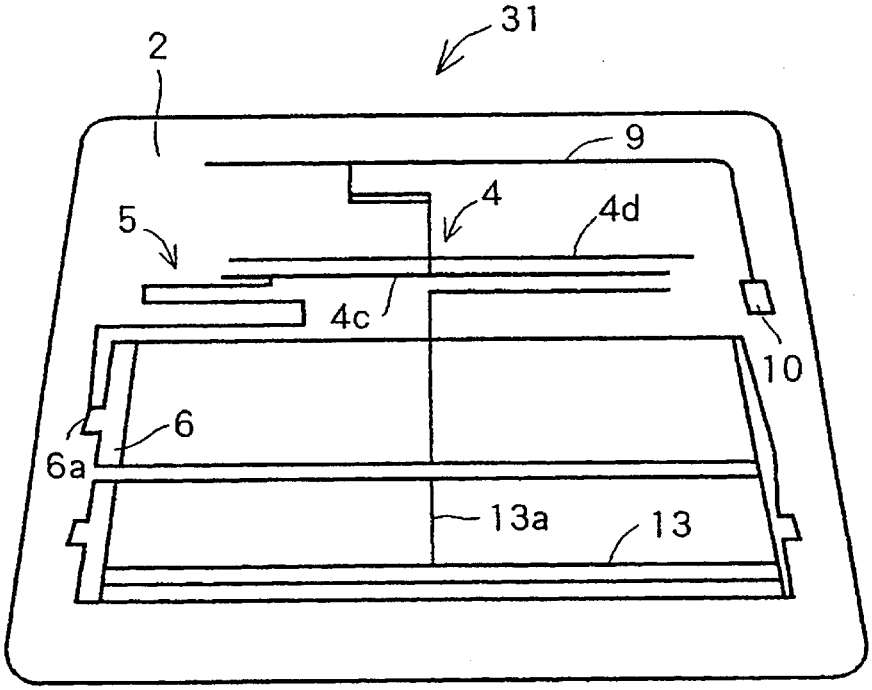
FIG. 9 is a schematic view of a window glass antenna according to a second embodiment of the present invention.

According to the second embodiment shown in FIG. 9, a window glass antenna 31 differs from the window glass antenna 1 according to the first embodiment in that an inverted T-shaped antenna wire 4 additionally has a second wire 4*d* parallel to a horizontal wire 4*c*, an inductive coupling wire 5 has a lower end connected to a power supply input terminal 6*a* of a bus 6, and an auxiliary wire 13 has a longer vertical section 13*a*.

Figure 10:
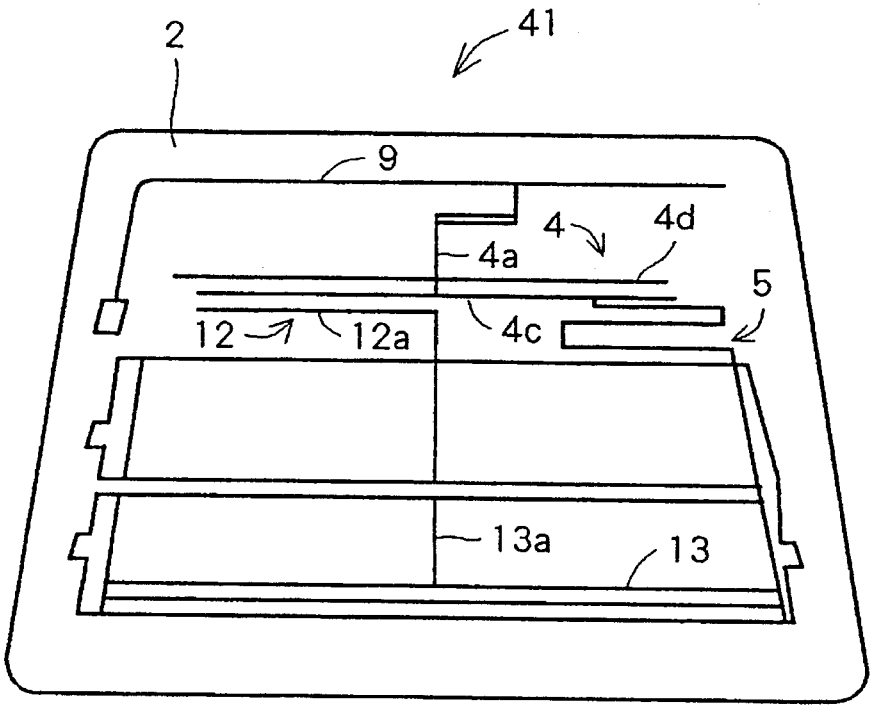
FIG. 10 is a schematic view of a window glass antenna according to a third embodiment of the present invention.

According to the third embodiment shown in FIG. 10, a window glass antenna 41 differs from the window glass antenna 1 according to the first embodiment in that an inverted T-shaped antenna wire 4 additionally has a second wire 4*d* parallel to a horizontal wire 4*c*, an auxiliary wire 13 has a longer vertical section 13*a*, and an inductive coupling wire 5, an auxiliary wire 9, a first feeding point 10, and a horizontal section 12*a* of an auxiliary wire 12 and those of the window glass antenna 1 shown in FIG. 1 are symmetrical with respect to the vertical central axis of the window glass panel 2, i.e., a vertical extension of the vertical antenna section 4*a* of the inverted T-shaped antenna wire 4.

Figure 11:
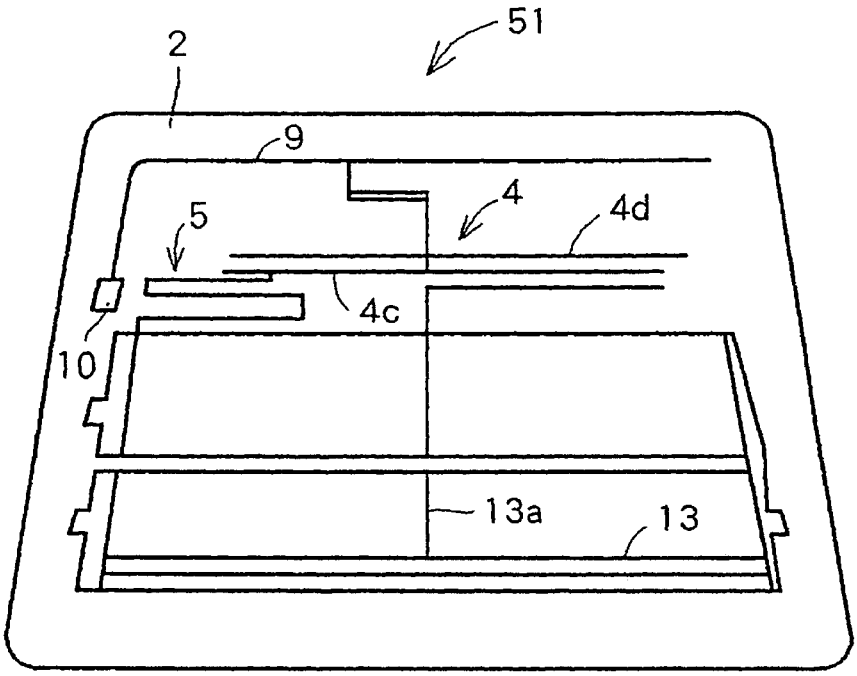
FIG. 11 is a schematic view of a window glass antenna according to a fourth embodiment of the present invention.

According to the fourth embodiment shown in FIG. 11, a window glass antenna 51 differs from the window glass antenna 1 according to the first embodiment in that an inverted T-shaped antenna wire 4 additionally has a second wire 4*d* parallel to a horizontal wire 4*c*, an auxiliary wire 13 has a longer vertical section 13*a*, and an auxiliary wire 9 and a first feeding point 10 and those of the window glass antenna 1 shown in FIG. 1 are symmetrical with respect to the vertical central axis of the window glass panel 2.

Figure 12:
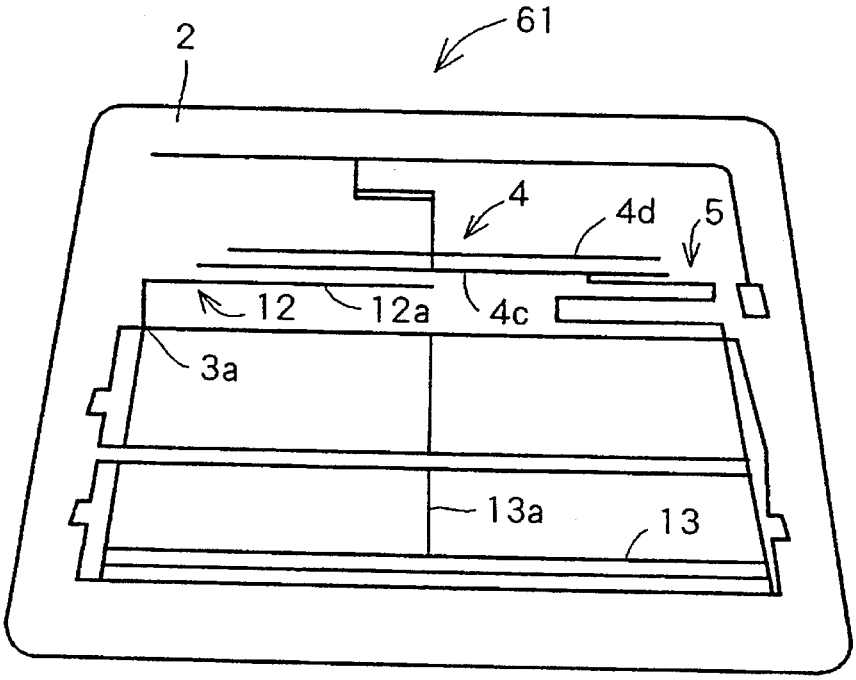
FIG. 12 is a schematic view of a window glass antenna according to a fifth embodiment of the present invention.
Figure 13:
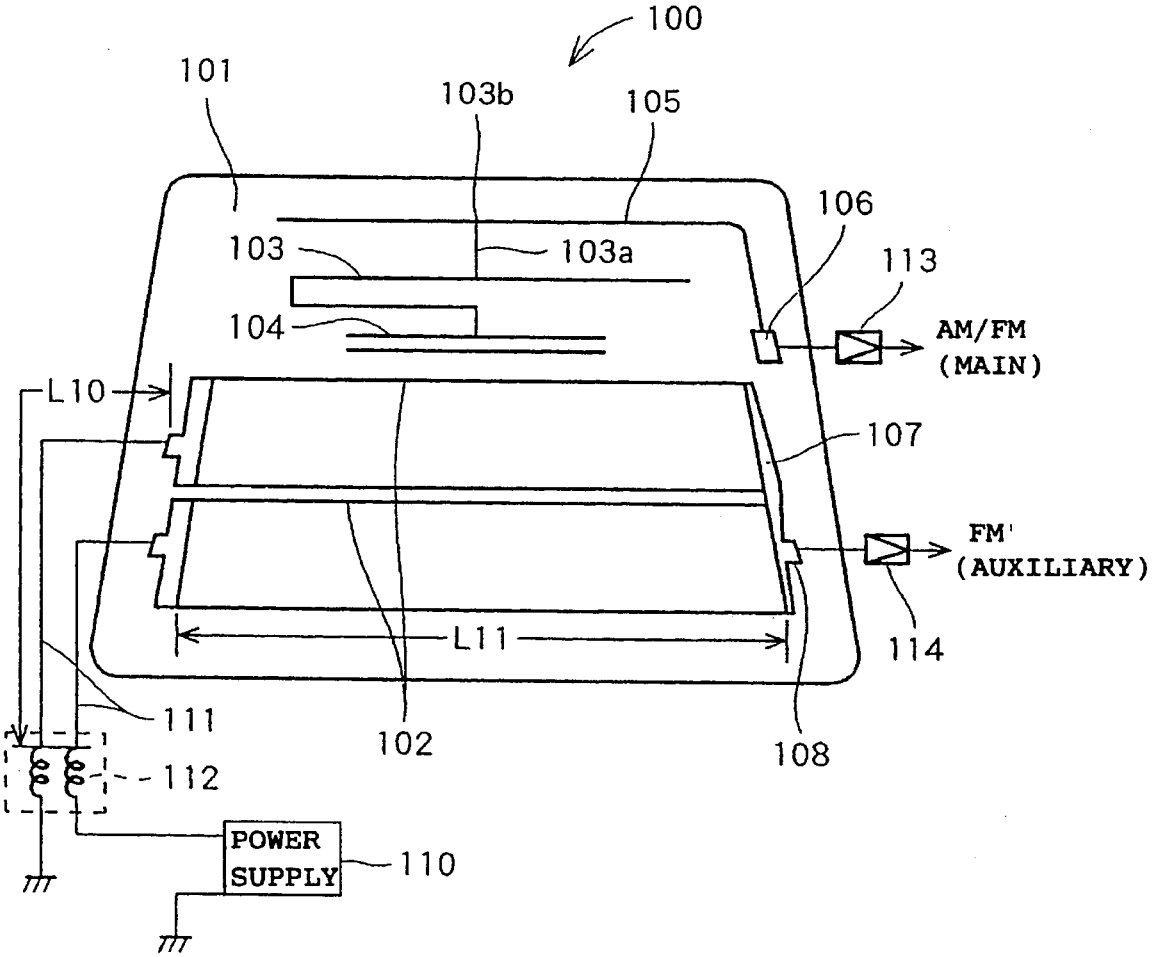
FIG. 13 (Prior Art)
FIG. 13 is a schematic view of a conventional window glass antenna.

According to the fifth embodiment shown in FIG. 12, a window glass antenna 61 differs from the window glass antenna 1 according to the first embodiment in that an inverted T-shaped antenna wire 4 additionally has a second wire 4*d* parallel to a horizontal wire 4*c*, an inductive coupling wire 5 is disposed on a right-hand side (as viewed in FIG. 12) of the window glass panel 2, an auxiliary wire 12 is disposed on a left-hand side of the window glass panel 2 and has a lower end connected to the left-hand ends 3*a* of the defrosting hot wires 3 of the upper group, and an auxiliary wire 13 has a longer vertical section 13*a*.

The above and further objects, details and advantages of the present invention will become apparent from the following detailed description of preferred embodiments thereof, when read in conjunction with the accompanying drawings.

What is claimed is:

1. A window glass antenna on a window glass panel, comprising:

defrosting hot wires disposed on the window glass panel and extending substantially horizontally;

an inverted T-shaped antenna wire disposed on the window glass panel in an unheated region above said defrosting hot wires;

an inductive coupling wire interconnecting said defrosting hot wires and said inverted T-shaped antenna wire for providing a relatively low impedance with respect to a relatively low frequency band;

a hot-wire power supply;

power supply lines connected between said defrosting hot wires and said hot-wire power supply;

a first high-frequency blocking coil inserted in said power supply lines for providing a high impedance with respect to said relatively low frequency band;

a second high-frequency blocking coil inserted in said power supply lines between said defrosting hot wires and said first high-frequency blocking coil for providing a relatively high impedance with respect to a relatively high frequency band, wherein said defrosting hot wires and a portion of said power supply lines extending from said defrosting hot wires to said first blocking coil form an AM-reception equivalent antenna having an effective length determined by a position of said first high-frequency blocking coil along said power supply lines, and said defrosting hot wires and a portion of said power supply lines extending from said defrosting hot wires to said second high-frequency blocking coil form an FM-reception equivalent antenna having an effective length determined by a position of said second high-frequency blocking coil along said power supply lines;

a first feeding point located on an end of said inverted T-shaped antenna wire to output an AM/FM signal; and a second feeding point located on an end of said defrosting hot wires to output an FM signal.

2. A window glass panel according to claim 1, wherein said inverted T-shaped antenna wire includes a horizontal antenna section, said inductive coupling wire being of a zigzag pattern connected between said horizontal antenna section and an end of said defrosting hot wires.

3. A window glass antenna for receiving AM and FM broadcast radiowaves in a diversity reception mode, comprising:

a window glass panel;

an inverted T-shaped antenna wire disposed on said window glass panel;

a plurality of horizontal defrosting hot wires disposed on said window glass panel in spaced relationship to said inverted T-shaped antenna wire;

an inductive coupling wire disposed on said window glass panel and connecting said inverted T-shaped antenna wire and said horizontal defrosting hot wires to each other;

power supply lines connected to said horizontal defrosting hot wires for energizing the horizontal defrosting hot wires; and first and second high-frequency blocking coils inserted in said power supply lines, said second high-frequency blocking coils being connected between said first high-frequency blocking coils and said horizontal defrosting hot wires, wherein an AM broadcast signal is received by an AM-reception equivalent antenna comprised of said horizontal defrosting hot wires and portions of said power supply lines bounded by said first high-frequency blocking coils, a first FM broadcast signal is received by said inverted T-shaped antenna wire, and a second FM broadcast signal is received by an FM-reception equivalent antenna comprised of said horizontal defrosting hot wires and portions of said power supply lines bound by said second high-frequency blocking coils.

4. A window glass panel according to claim 3, wherein said inverted T-shaped antenna wire includes a horizontal antenna section, said inductive coupling wire being of a zigzag pattern connected between said horizontal antenna section and an end of said horizontal defrosting hot wires.

* * * * *